US007402224B1

(12) United States Patent
Avignon et al.

(10) Patent No.: US 7,402,224 B1
(45) Date of Patent: Jul. 22, 2008

(54) METHOD FOR PRODUCING PAPER PULP, LIGNINS, SUGARS AND ACETIC ACID BY FRANTIONATION OF LIGNOCELLULOSIC VEGETABLE MATERIAL IN FORMIC/ACETIC ACID MEDIUM

(75) Inventors: Gérard Avignon, Estillac (FR); Michel Delmas, Auzeville Tolosane (FR)

(73) Assignee: Compagnie Industrielle de la Matiere Vegetale, Paris (FR)

( * ) Notice: Subject to any disclaimer, the term of this patent is extended or adjusted under 35 U.S.C. 154(b) by 0 days.

(21) Appl. No.: 10/490,555

(22) PCT Filed: May 6, 1999

(86) PCT No.: PCT/FR99/01071

§ 371 (c)(1),
(2), (4) Date: Oct. 27, 2004

(87) PCT Pub. No.: WO00/68494

PCT Pub. Date: Nov. 16, 2000

(51) Int. Cl.
*D21C 3/20* (2006.01)

(52) U.S. Cl. ..... 162/76; 162/19; 162/60; 162/56; 162/65; 162/37; 162/78; 162/241; 162/250

(58) Field of Classification Search ..... 162/76, 162/19, 60, 56, 241, 65, 37, 78, 250
See application file for complete search history.

(56) References Cited

U.S. PATENT DOCUMENTS 6,139,683 A * 10/2000 Nimz et al. ..... 162/19

FOREIGN PATENT DOCUMENTS

| | | |
|---|---|---|
| DE | 38 30 993 | 4/1989 |
| DE | 195 16 151 | 11/1996 |
| EP | 0 584 675 | 3/1994 |
| FR | 2 770 543 | 5/1999 |
| WO | WO 95/21960 | 8/1995 |

* cited by examiner

*Primary Examiner*—Mark Halpern
(74) *Attorney, Agent, or Firm*—Young & Thompson

(57) ABSTRACT

A method for producing paper pulp from a lignocellulosie vegetable raw material. The method includes contacting the raw material with a mixture of formic acid and acetic acid (in an amount more than 5 wt. % of the mixture) at a temperature and for a suitable reaction time, the whole being performed at room temperature. The paper pulp is separated from the organic phase and optionally bleached with ozone. The organic phase is treated to enable the recycling of the formic and acetic acids and the extraction of lignins, sugars and excess acetic acid.

17 Claims, No Drawings

METHOD FOR PRODUCING PAPER PULP, LIGNINS, SUGARS AND ACETIC ACID BY FRANTIONATION OF LIGNOCELLULOSIC VEGETABLE MATERIAL IN FORMIC/ACETIC ACID MEDIUM

This application is a 371 of PCT/FR99/01071 filed 6 May 1999.

FIELD OF THE INVENTION

The invention concerns a process for producing paper pulp, lignins, sugars and acetic acid from lignocellulosic plant material constituting the essential part of annual and perennial plants.

From now on, an annual plant is understood to be any plant having a vegetative life of the order of one year (cereals, various grasses, cotton, hemp, flax, sorghum, sugar cane, reeds, etc.) and a perennial plant is understood to mean a plant of which the development extends over a longer period (bamboos, broad-leafed wood, resinous wood, etc.).

The lignocellulosic materials of the invention are whole plants or parts of these plants (stems, bark, etc.) or co-products from industrial processes aimed at the production of foods, (wheat straw, rice, barley; sugar cane bagasse, sugar sorghum bagasse, etc.).

Paper pulps produced from annual or perennial plants may be classified according to the technology used, their paper-making quality and the mass yield obtained relative to the initial plant material.

The paper-making quality of a pulp is defined in relation to the process for separating cellulosic fibres or defibration and relative to a series of physico-chemical parameters of which the most important are the breaking length which relates to the tensile strength, the tear index and the burst index. The higher these properties, the better will be the quality of the pulp produced.

The following are thus considered:

- so-called mechanical or thermomechanical low-quality pulps, which are obtained with a yield of the order of 80 to 90% by mechanical or thermomechanical processes,
- chemicothermomechanical pulps or semi-chemical pulps of medium quality, which are obtained with a yield of the order of 60 to 80% by chemicothermomechanical or semi-chemical processes,
- superior quality chemical pulps which are obtained with a yield of the order of 40 to 50% by chemical processes.

In the case of annual plants, the particular nature of the lignocellulosic material does not always allow suitable values for the breaking length (greater than 4000 meters) to be obtained, even with chemical processes.

It should be recalled that the breaking length, an essential characteristic of paper pulp and paper corresponds to the length of a uniform strip of any width assumed to be suspended by one of its ends breaking under the effect of its own weight. This breaking length is calculated by the formula $106 \times RT/15\ G \cdot g$ in which:

- RT is the tensile breaking strength expressed in newton per meter (NF standard Q 03 002)
- G is the grammage of the paper strip expressed in $g/m^2$.
- g is the acceleration due to gravity ($9.81\ m/s^2$).

BACKGROUND OF THE INVENTION

Processes for the production of quality paper pulps, capable of obtaining, with most plants, suitable breaking lengths, are by nature essentially chemical in which the cellulosic fibres of the lignocellulosic plant material are freed from plant cement which binds them in the plants, consisting of hemicelluloses (sugar polymers with 5 to 6 carbons) and lignins (polymers of substituted allylphenols) by a chemical hydrolysis action in a concentrated basic or acidic aqueous medium, often in the presence of sulphur in different oxidation states.

These processes are at the present time employed essentially in existing industrial units throughout the world.

They have a major disadvantage in that they require considerable quantities (approximately 20% by weight) of inorganic chemical products during the cooking of the plants to make paper pulp. These inorganic chemical products are necessarily, but with difficulty, recycled and they are often the origin of foul odours due to the presence of sulphur.

Moreover, these factories require enormous investments in order to meet basically acceptable environmental standards, and they are therefore only profitable for a high critical size of the order of 100 to 200,000 tonnes of pulp produced per year.

A technological improvement has been obtained by replacing all or part of the water by an organic solvent of the alcohol, ketone or ester type, which makes it possible to overcome the use of sulphur, but not basic reagents, and therefore problems of recycling these reagents remain. These so-called "organosolve" technologies which require high pressures and involve high operating costs, are not as yet developed industrially for these reasons.

With the same idea in mind, other technologies of the same type using organic acids for hydrolysing hemicelluloses and lignins and at the same time for freeing cellulose fibres have been developed on the pilot plant scale. These technologies make it possible to do away with inorganic reagents completely, which is a considerable advantage.

Formic acid (B. BUCHOLZ and R K. JORDAN Pulp and Paper, p. 102-104, 1983; M N. ERISMANN et al., Bioresource Technology, Vol. 47, p. 247-256, 1994) can be used and it makes it possible to make acceptable paper pulps without pressure.

This technology also makes it possible to preserve in the paper pulps the silica contained in the plant, which is an important advantage when annual plants are used as a raw material since silica considerably disrupts the recovery of inorganic reagents in current industrial processes in a basic medium.

A variant of the process such as one under the name MILOX proceeds by cooking with formic acid in several stages in the presence of hydrogen peroxide, which improves delignification (K. POPPIUS-LEVLIN et al., Tappi Journal, Vol. 80, No. 9, p. 215-221, 1997).

Acetic acid can be used with the same aim but under pressure at a higher temperature (160 to 180° C.) at concentrations in water of 50 to 90% (R. A. YOUNG and J. L. DAVIS, Holzforschung, Vol. 40, p. 99-108, 1986).

Delignification is correct but the process requires washing of the pulp with acetone in order to remove lignins precipitated on the pulp.

A variant of this process makes it possible, with oxygen under pressure, to reduce the cooking time and to improve delignification (C. P. NETO and A. ROBERT, Holzforschung, Vol. 46, p 233-240, 1993) but it is at the origin of partial depolymerisation of cellulose by the joint action of pH and oxygen.

A variant of the MILOX process using acetic acid and hydrogen peroxide in two stages at 160-170° C. has also been proposed (K. POPPIUS-LEVLIN et al., Paper and Timber, Vol. 73, p. 154-158, 1991) but it does not provide any considerable improvement.

The limited acidity of acetic acid has led to its hydrolysis capacity being reinforced by the addition of hydrochloric acid (J. C. PAJARO et al., Holz als Roh-und Werkstoff, Vol. 54, p. 119-125, 1996) at 115-130° C. The reduction in the reaction temperature is the principal improvement of the process which has a major advantage of introducing chlorine ions into the process (G. VASQUES et al., Holzforschung, Vol. 49, No. 1, p. 69-73, 1995).

In addition, it should be pointed out that all the technologies using, in two or more stages, an organic acid and hydrogen peroxide generating peroxyacids in situ, are detailed in the review (N. LIEBERGOTT Pulp and Paper Canada, Vol. 97, No. 2, p. 45-48, 1996).

It should be added that technologies for bleaching these pulps without chlorine use hydrogen peroxide in a basic medium, which involves the regulation of silica in the form of sodium silicate causing considerable problems during the draining of pulps and the recycling of reagents.

The object of the present invention is to provide a novel process for producing paper pulp at atmospheric pressure from annual or perennial plants which leads to good-quality chemical pulps preserving the endogenous silica in their structure.

Document EP-A-0 584 675 teaches a process for extracting cellulose from lignocelluloses, by heating for two hours at high temperatures (170° C. or 180° C.) and under pressure in the presence of aqueous acetic acid with the addition of formic acid.

Document WO-A-95/21960 describes a process for cooking lignocellulosic materials, in particular from annual plants, with a mixture of carboxylic acids, involving a compulsory pyrolysis step.

The object of the invention is a process which makes it possible to obtain these performances whatever the nature of the plants used and which is thus particularly valuable in the case of annual plants in order to open up the way to new economic developments, in particular in the case of cereal straw and cane sugar bagasse or sugar sorghum bagasse.

SUMMARY OF THE INVENTION

To this end, the process for producing paper pulp, lignins, sugars and acetic acid according to the invention is characterised in that it combines the following steps:

(i) the annual or perennial plants, used partially or totally, which constitute the lignocellulosic starting raw material, are placed in contact with a mixture of formic acid containing at least 5% of acetic acid by weight, and the whole is brought to a reaction temperature higher than 50° C.;

(ii) the solid fraction constituting the paper pulp is then separated from the organic phase, especially containing in solution the starting formic acid and acetic acid, solubilized monomeric and polymeric sugars, lignins and acetic acid derived from the initial plant raw material.

The process according to the invention results from the following surprising observation: the addition of acetic acid to formic acid makes it possible to increase considerably the dissolving power of the liquid organic phase as defined as regards hemicelluloses and lignins without affecting the capacity of formic acid for the acid hydrolysis of these biopolymers. In this way, degradation of cellulosic fibres is prevented which appears with concentrated formic acid alone under normal conditions of use, and thus the paper-making quality of the paper pulp obtained is preserved.

Strong pulps are then obtained which separate easily from the reaction medium and which drain easily on account of the non-salting out of endogenous silica.

This property is particularly valuable since it is the principal factor limiting the use of chemical pulps from straw in particular in fast paper machines of which they slow the speed.

It should be emphasised that the acetic and formic acids are recycled. Losses in the process do not exceed 1% by weight per tonne of pulp produced, which is negligible.

The mechanisms by which formic acid and acetic acid act in synergy in the first moments of cooking remain difficult to explain.

Nevertheless, a hypothesis may be advanced that, under the operating conditions in accordance with the process of the invention, the low hydration of the medium associated with the water provided by the initial lignocellulosic materials promotes the dissociation of formic acid, which brings about controlled hydrolysis of the hemicelluloses/lignins complex.

Under these conditions, acetic acid, preferably in molecular form, solubilises lignins freed in this way more easily. This effect makes it possible to limit the reaction time and the possible formylations of free hydroxyl groups of cellulose which degrade the paper-making qualities of the pulp.

The progressive release of acetic acid derived from the acetyl groups of hemicelluloses reinforces this effect, but it does not make it possible to obtain the performances observed in the process on account of its quantity that is too small in relation to the initial formic acid.

The process according to the invention may be put into operation from plants or parts of plants of the following types:

- cereal straw (wheat, barley, rye, oats, tritical, rice, etc.)
- annual plants (cotton, hemp, flax, reed, etc.)
- perennial plants (bamboos, broad-leafed wood, resinous wood, etc.)
- sugar cane bagasse, sugar sorghum bagasse.

The process makes possible particularly valuable economic utilisation of annual plants, in particular straw and bagasse, which are considered in the processes for producing traditional chemical pulps as products of the second category without great value.

Care is preferably taken to ensure that the moisture content of the initial lignocellulosic material is less than or equal to 25% by weight of water based on the dry matter.

The lignocellulosic raw material is preferably ground so as to reduce it into fragments or chips substantially of between 0.5 and 20 cm in length.

DETAILED DESCRIPTION OF THE INVENTION

According to a first embodiment, the plant material is pre-impregnated at a temperature at least 30° C. below the reaction temperature. The impregnation by immersion is performed for a period from between 10 to 30 minutes in the formic acid/acetic acid mixture used during the fractionation reaction. Impregnation and the fractionation reaction which follow are carried out at atmospheric pressure.

Fractionation is here understood to mean the reaction process usually know under the name of cooking which, under the conditions of the invention, leads, in addition to paper pulp, to easily separable products, which is not the case in most conventional processes.

According to another embodiment, the fractionation reaction is performed at a temperature below or equal to the reflux temperature of the mixture.

The liquid/solid mass ratio will preferably be between 4 and 11.

Separation of the paper pulp from the organic phase at the end of cooking is preferably performed by pressing.

Another preferred embodiment specifies that the pulp separated in this way is washed with a mixture of formic acid and acetic acid or with pure acetic acid. The pulp from which most of the lignin residues and sugars have been removed is then washed with hot water.

Another preferred embodiment proceeds with cooking in at least two stages in order to improve delignification and therefore the quality of the pulps.

The first stage is performed in the presence of the formic acid/acetic acid mixture. The second stage is performed after having separated the pulp produced in the first stage in the presence of anhydrous acetic acid. Pulp washings are carried out with acetic acid.

One preferred embodiment specifies the control of pH during washing in an organic acid medium so that the paper pulp is at an ideal pH for bleaching with ozone in 1 or 2 sequences, at a dryness of the pulp of the order of 40 to 60%.

Another preferred embodiment specifies the separation of formic acid and acetic acid by evaporation under vacuum, the separation of entrained water, the recycling of formic and acetic acids in the required proportions and the recovery of excess acetic acid and water.

Another embodiment specifies taking up the lignins/sugars mixture in water and filtering or centrifuging the suspension in order to separate the lignins precipitated from the acidic aqueous sugar-containing phase. The latter is concentrated by evaporation under vacuum in order to recover the sugars and to recycle the condensed water.

The process of the invention is illustrated in the following examples:

EXAMPLE NO. 1

38 g of rice straw with 88% dryness (33.5 g of dry matter) were put into contact at ambient temperature (20° C.) with a mixture containing 150 g of pure formic acid and 150 g of pure acetic acid in a 2-liter reactor fitted with a central mechanical stirrer, an open condenser and a thermometer. Mechanical stirring was maintained at ambient temperature for 15 minutes which corresponded to the impregnating time.

The suspension was brought to a temperature of 100° C. in 35 minutes by means of a thermostatically controlled heating bath. This temperature was kept steady for 60 minutes. The pulp was drained and separated by pressing and was then washed twice in the reactor with 150 ml of a formic acid/acetic acid mixture in the initial reaction proportions for a period of 10 minutes.

The acidic washing solutions were separated from the pulp by filtration and pressing and the pulp was then washed with hot water in order to recover the residual traces of acids. The pulp was then washed with cold water until neutral.

The mechanical properties of the pulp obtained were as follows:

GR (grammage): 72.35 g/m$^2$; NF standard: Q 03019

T (thickness): 0.12 mm; NF standard: Q 03053

BL (breaking length): 4262 m; NF standard: Q 03002

TI (tear index): 337 mN·m$^2$/g; NF standard: Q 03011

BI (burst index): 1.66 kPa; NF standard: Q 03053

EXAMPLE NO. 2

38 g of rice straw with 90% dryness (34.2 g of dry matter) were put into contact at ambient temperature (20° C.) with a mixture containing 210 g of pure formic acid and 90 g of pure acetic acid in a 2-liter reactor fitted with a central mechanical stirrer, an open condenser and a thermometer. Mechanical stirring was maintained at ambient temperature for 15 minutes which corresponded to the impregnating time.

The suspension was brought to a temperature of 85° C. in 25 minutes by means of a thermostatically controlled heating bath. This temperature was kept steady for 60 minutes. The pulp was drained and separated by pressing and was then washed twice in the reactor with 150 ml of a formic acid/acetic acid mixture in the initial reaction proportions for a period of 10 minutes.

The acidic washing solutions were separated from the pulp by filtration and pressing and the pulp was then washed with hot water and then cold water.

The mechanical properties of the pulp obtained were as follows:

GR (grammage): 74.17 g/m$^2$; NF standard: Q 03019

T (thickness): 0.125 mm; NF standard: Q 03053

BL (breaking length): 4517 m; NF standard: Q 03002

TI (tear index): 329 mN·m$^2$/g; NF standard: Q 03011

BI (burst index): 1.83 kPa; NF standard: Q 03053

The pulp obtained (30 g) was then placed in a closed static reactor enabling a mixture of air and 1% ozone to diffuse through a sinter on which the pulp at a pH of 3 to approximately 50% dryness rested.

Bleaching was performed in two 20-minute sequences of gas-solid contact. Water washing was carried out between each sequence.

The whiteness index, measured with the aid of the ELREPHO spectrophotometer 2000 according to NF standard Q 03039, passed from 28.1 photovolts for the raw pulp to 68.2 photovolts for the pulp bleached under these conditions.

The mixture of formic and acetic acids obtained by evaporating the solution of sugars and lignins contained water provided by the lignocellulosic raw materials.

This water was separated from the mixture of acids by azeotropic distillation with the aid of a third body which could have been: ethyl acetate, benzene, toluene, n-butylethylether, cyclohexane, etc.

The excess acetic acid coming from the acetyl groups of the lignocellulosic material could then be separated off simply by rectification.

Under these conditions, 100 g of rice straw corresponding substantially to three identical tests under the experimental conditions described above provided the reaction medium with approximately 10 g of water. The organic liquid phase contained substantially 880 g of acetic and formic acids and 9.5 g of water. It was treated with 109 g of ethyl acetate. The ethyl acetate-water azeotrope (B.Pt 70.4° C. at 760 mm Hg, with a water concentration of 8.2% by weight) was extracted at the head of the distillation column and condensed.

Ethyl acetate was separated from water in a decanter and was recycled to the head of the column. The dried acetic acid/formic acid mixture was extracted at the foot of the column and could then be distilled in a rectifying column so as to recover the excess acetic acid.

The formic and acetic acids were then recycled to the cooking process in suitable proportions.

After evaporating off the organic acids, the mixture of sugars and lignins was treated with water recovered during washing of the pulp.

The lignins precipitated and were separated off by filtration and then dried. 11.2 g of lignins were recovered in this way. The sugar-containing solution was then evaporated, enabling the mixture of sugars mainly containing sugars with five carbon atoms to be finally recovered. The quantity of sugars recovered was 19.1 g.

EXAMPLE NO. 3

38 g of sorghum bagasse with 88% dryness (33.5 g of dry matter) were put into contact at ambient temperature (20° C.) with a mixture containing 220 g of pure formic acid and 90 g of pure acetic acid in a 2-liter reactor fitted with a central mechanical stirrer, an open condenser and a thermometer. Mechanical stirring was maintained at ambient temperature for 30 minutes which corresponded to the impregnating time.

The suspension was brought to a temperature of 100° C. in 30 minutes by means of a thermostatically controlled heating bath. This temperature was kept steady for 60 minutes. The pulp was drained and separated by pressing and was then washed twice in the reactor with 150 ml of a formic acid/acetic acid mixture in the initial reaction proportions for a period of 10 minutes.

The acidic washing solutions were separated from the pulp by filtration and pressing and the pulp was then washed with hot water in order to recover the residual traces of acids. The pulp was then washed with cold water until neutral.

The paper pulp obtained was characterized by its viscosimetric degree of polymerisation (DPv). The measurement was performed with the aid of a capillary viscometer of the "Commission de la Cellulose" type which serves to determine the intrinsic viscosity (in mPA·s) of natural or regenerated cellulose (NF T 12-005). The observed value is linked to the degree of polymerisation by the relationship DPv=(0.75 (954 log v−325))1.105 in which v is the measured viscosity, and therefore for the sugar sorghum bagasse pulp obtained under the experimental conditions described above, a DPv=1680, characteristic of a good-quality pulp.

EXAMPLE NO. 4

38 g of rice straw with 88% dryness (33.5 g of dry matter) were put into contact at ambient temperature (20° C.) with a mixture containing 220 g of pure formic acid and 90 g of pure acetic acid in a 2-liter reactor fitted with a central mechanical stirrer, an open condenser and a thermometer. Mechanical stirring was maintained at ambient temperature for 15 minutes which corresponded to the impregnating time.

The suspension was brought to a temperature of 100° C. in 30 minutes by means of a thermostatically controlled heating bath. This temperature was kept steady for 60 minutes. The pulp was drained and separated by pressing. The pulp was subjected to a second cooking with glacial acetic acid (150 ml) at a temperature of 90° C. for 30 minutes.

The new pulp obtained was drained, separated by pressing and washed three times with acetic acid (150 ml) for 15 minutes for each washing at a temperature of 95° C.

The acidic washing solutions were separated from the pulp by filtration and pressing and, and the pulp was then washed with hot water in order to recover the residual traces of acids. The pulp was then washed with cold water until neutral.

The degree of polymerisation of the sugar sorghum pulp measured under the conditions of example 3 had a particularly high value for DPv=2360 characteristic of a superior-quality paper pulp.

The invention claimed is:

1. Process for producing paper pulp, lignins, sugars and acetic acid, from a lignocellulosic plant material, which comprises the following successive steps:

(i) impregnating the lignocellulosic plant material at atmospheric pressure and at a first temperature, higher than 50° C., by immersion with a mixture of formic acid containing at least 5% of acetic acid by weight, so as to obtain a suspension;

(ii) subjecting the suspension to a fractionation reaction at a reaction temperature of between 50° C. and 115° C.; and (iii) separating at atmospheric pressure and at said reaction temperature a solid fraction constituting paper pulp from an organic phase containing in solution the starting formic acid and acetic acid, solubilized monomeric and polymeric sugars, lignins and acetic acid derived from the plant material.

2. The process according to claim 1, wherein said step (i) comprises a pre-impregnation step consisting of subjecting the lignocellulosic plant material to one or more additional phases of contact with a formic acid/acetic acid mixture at a temperature at least 30° C. below the reaction temperature of step (ii).

3. The process according to claim 1, wherein the initial lignocellulosic plant material has a moisture content of less than or equal to 25% by weight of water based on dry matter.

4. The process according to claim 1, wherein the lignocellulosic plant material is ground into fragments or chips of between about 0.5 and 20 cm in length.

5. The process according to claim 1, wherein the impregnation by immersion is performed for a period of from 10 to 30 minutes in the formic acid/acetic acid mixture used during the fractionation reaction.

6. The process according to claim 1, wherein the fractionation reaction is performed at a temperature below or equal to the reflux temperature of the mixture.

7. The process according to claim 1, wherein the liquid/solid mass ratio is between 4 and 11.

8. The process according to claim 1, wherein the contact time between the plant material and the formic acid/acetic acid mixture is between 1 hour and 2 hours.

9. The process according to claim 1, wherein the solid fraction constituting the paper pulp is separated from the organic liquid phase by pressing.

10. The process according to claim 1, wherein the separated solid fraction constituting the paper pulp is washed with a mixture of formic acid and acetic acid in the reaction proportions.

11. The process according to claim 10, wherein the washing is performed using anhydrous acetic acid.

12. The process according to claim 10, further comprising controlling the pH during washing so as to maintain the paper pulp, at a dryness of between 40% and 60%, and at a pH allowing optimum bleaching with ozone in one or more sequences.

13. The process according to claim 1, wherein the paper pulp obtained is washed with hot water.

14. The process according to claim 1, further comprising subjecting the organic phase to evaporation under vacuum to separate the formic acid and the acetic acid from the pulp, lignins and sugars.

15. The process according to claim 14, wherein the formic acid/acetic acid/water mixture is treated so as to allow the recycling of the acetic acid/formic acid mixture at the desired concentration, the recovery of the acetic acid obtained from the starting cellulosic material, and the separation of excess water.

16. The process according to claim 14, wherein the mixture of lignins and sugars is treated with water and then filtered to separate precipitated lignins from an acidic aqueous sugar-containing phase.

17. The process according to claim 16, wherein the sugars dissolved in the sugar-containing phase are separated therefrom by evaporation of the water under vacuum.

* * * * *